US009039581B2

(12) United States Patent
Chia et al.

(10) Patent No.: US 9,039,581 B2
(45) Date of Patent: May 26, 2015

(54) EXERCISE APPARATUS

(71) Applicant: REXON INDUSTRIAL CORP., LTD., Taichung (TW)

(72) Inventors: Benjamin Chia, San Jose, CA (US); Yi-Chun Liao, Taichung (TW)

(73) Assignee: REXON INDUSTRIAL CORP., LTD., Taichung (TW)

( * ) Notice: Subject to any disclaimer, the term of this patent is extended or adjusted under 35 U.S.C. 154(b) by 298 days.

(21) Appl. No.: 13/854,375

(22) Filed: Apr. 1, 2013

(65) Prior Publication Data

US 2013/0260964 A1 Oct. 3, 2013

Related U.S. Application Data

(60) Provisional application No. 61/618,920, filed on Apr. 2, 2012.

(30) Foreign Application Priority Data

Apr. 2, 2012 (TW) ..... 101111712 A

(51) Int. Cl.
*A63B 22/06* (2006.01)
*A63B 22/00* (2006.01)
(Continued)

(52) U.S. Cl.
CPC ..... *A63B 22/06* (2013.01); *A63B 22/0015* (2013.01); *A63B 22/0046* (2013.01); *A63B 22/0605* (2013.01); *A63B 2022/0652* (2013.01); *A63B 2208/0233* (2013.01)

(58) Field of Classification Search
CPC ..... A63B 22/06; A63B 22/0046; A63B 22/0605; A63B 2208/0233; A63B 22/0015; A63B 2022/0652; A63B 22/0048; A63B 22/0087; A63B 22/0635; A63B 22/0064; A63B 22/0641; A63B 2022/0647; A63B 22/0664
USPC ..... 482/51–53, 57–69, 72–73, 78, 131–139
See application file for complete search history.

(56) References Cited

U.S. PATENT DOCUMENTS 2,145,940 A * 2/1939 Marlowe ..... 482/72
3,578,800 A * 5/1971 DiNepi ..... 482/57
(Continued)

FOREIGN PATENT DOCUMENTS

CN 100536961 C 9/2007
FR 2440753 A * 7/1980
(Continued)

OTHER PUBLICATIONS

Taiwanese Office Action dated Nov. 27, 2013, for TW 101111712, and English translation thereof.

*Primary Examiner* — Oren Ginsberg
*Assistant Examiner* — Joshua Lee
(74) *Attorney, Agent, or Firm* — Bacon & Thomas, PLLC

(57) ABSTRACT

An exercise apparatus includes a base providing a relatively higher first terminal end, a relatively lower second terminal end, and a track between the first and second terminal ends. The exercise apparatus also includes a seat unit movable along the track between a first position adjacent to the first terminal end and a second position located far apart from the first terminal end. A distance difference relative to the seat unit is produced by a wheel pedal unit movable along the track between a first pedaling position adjacent to the second terminal end and located horizontally far apart from the seat unit, and a second pedaling position located far from the second terminal end and horizontally adjacent to the seat unit. Thus, changing the position of the wheel pedal unit and the position of the seat unit can change the distance difference between the seat unit and the wheel pedal unit in both the vertical and horizontal directions. This enables a user to selectively perform different exercise modes in either a normal sitting posture or a recumbent sitting posture.

20 Claims, 7 Drawing Sheets

(51) Int. Cl.

| | |
|---|---|
| ***A63B 21/00*** | (2006.01) |
| ***A63B 69/16*** | (2006.01) |
| ***A63B 71/00*** | (2006.01) |

(56) References Cited

U.S. PATENT DOCUMENTS

| | | | | | |
|---|---|---|---|---|---|
| 3,727,608 | A * | 4/1973 | Simsian | 601/146 |
| 3,910,571 | A * | 10/1975 | Stenn | 482/60 |
| 4,796,882 | A * | 1/1989 | Jiumr | 482/57 |
| 5,178,593 | A * | 1/1993 | Roberts | 482/62 |
| 5,549,527 | A * | 8/1996 | Yu | 482/57 |
| 5,782,639 | A * | 7/1998 | Beal | 434/29 |
| 5,951,447 | A * | 9/1999 | Butler | 482/111 |
| 6,001,071 | A * | 12/1999 | Butler | 601/36 |
| 6,071,215 | A | 6/2000 | Raffo et al. | |
| 6,551,219 | B1 * | 4/2003 | Brown | 482/57 |
| 6,692,411 | B1 * | 2/2004 | Stearns et al. | 482/57 |
| 6,926,645 | B1 * | 8/2005 | Stearns et al. | 482/62 |
| 7,097,598 | B2 * | 8/2006 | Lee | 482/57 |
| 7,393,308 | B1 * | 7/2008 | Huang | 482/51 |
| 7,758,475 | B2 * | 7/2010 | Goldberg | 482/62 |
| 7,819,782 | B2 * | 10/2010 | Yamazaki | 482/73 |
| 7,867,146 | B2 * | 1/2011 | Ge et al. | 482/51 |
| 8,062,190 | B2 * | 11/2011 | Pyles et al. | 482/57 |
| 8,062,192 | B1 * | 11/2011 | Arstein | 482/57 |
| 2002/0004439 | A1 * | 1/2002 | Galbraith et al. | 482/57 |
| 2002/0016236 | A1 * | 2/2002 | Stearns et al. | 482/57 |
| 2004/0259694 | A1 * | 12/2004 | Yang | 482/63 |
| 2005/0239608 | A1 * | 10/2005 | Somwong | 482/57 |
| 2008/0085819 | A1 | 4/2008 | Yang | |
| 2009/0197744 | A1 * | 8/2009 | Yamazaki | 482/57 |
| 2010/0130331 | A1 * | 5/2010 | Hu | 482/57 |
| 2012/0115695 | A1 * | 5/2012 | Watterson et al. | 482/142 |
| 2013/0130798 | A1 * | 5/2013 | Nir et al. | 463/36 |

FOREIGN PATENT DOCUMENTS

| | | | |
|---|---|---|---|
| GB | 2361651 | A * | 10/2001 |
| JP | 2006345904 | A | 12/2006 |
| JP | 3139553 | U | 1/2008 |
| JP | 3143723 | U * | 7/2008 |
| TW | 361273 | | 6/1999 |
| TW | M265032 | U | 5/2005 |
| TW | I299668 | B | 8/2008 |
| TW | M413517 | U | 10/2011 |

* cited by examiner

EXERCISE APPARATUS

CROSS REFERENCE TO RELATED APPLICATION(S)

This application claims, under 35 U.S.C. §119(e), priority to U.S. Provisional Application No. 61/618,920, filed Apr. 2, 2012, which application is hereby incorporated by reference in its entirety, inclusive of the specification, claims, and drawings.

FIELD OF THE INVENTION

The present invention relates to an exercise apparatus and more particularly, to a support frame for an exercise apparatus, which allows for changes in seating position to perform different exercise modes.

BACKGROUND

Referring to FIGS. 1 and 2, U.S. Pat. No. 6,071,215 discloses a multi-mode exercise machine 1, which includes an exercise base station 11, a pedal unit 12 mounted to the exercise base station 11, a cycle seat 13 supported on the pedal unit 12, an arm 14 pivotally mounted to the exercise base station 11 at one side relative to the pedal unit 12. Handlebars 15 are mounted to one end of the arm 14, and a second seat 16 is slidably coupled to the arm 14. A receivable pull rope unit 17 is pivotally mounted to the pedal unit 12, and a footrest unit 18 is pivotally mounted to the other end of the arm 14. The pull rope unit 17 includes a pull rope 171 passing around a guide roller inside the pedal unit 12, and a pull bar 172 connected to one end of the pull rope 171 and disposed outside the pedal unit 12.

When the arm 14 is set in a vertical position, a user can sit on the cycle seat 13 and hold the handlebars 15 with their hands, and then operate the pedal unit 12 with their feet for performing a first exercise mode. Alternatively, when the arm 14 is set in a horizontal position, the user can sit on the second seat 16 in a recumbent posture to hold the pull bar 172 with their two hands and then place their feet in the foot rest unit 18. By means of pulling up or letting off the pull rope 171, the second seat 16 is moved along the arm 14 for performing a second exercise mode.

The aforesaid prior art multi-mode exercise machine 1 can provide both upright and recumbent exercise modes. However, it must provide two seats (the cycle seat 13 and the second seat 16), two handles (the handlebars 15 and the pull bar 172) and two foot portions (the pedal unit 12 and the foot rest unit 18). Including two versions of each of these components disadvantageously complicates the structure and operation of this prior art exercise machine 1.

SUMMARY OF THE INVENTION

The present invention has been accomplished under the circumstances in view. It is the main object of the present invention to provide an exercise apparatus, which has a simple structure, facilitates operation, and allows change of exercise modes.

To achieve this and other objects of the present invention, an exercise apparatus comprises a base, a seat unit, and a wheel pedal unit. The base comprises a first terminal end and a second terminal end disposed at different elevations and spaced apart from each other at a predetermined distance. The base also comprises a track means extending between the first and second terminal ends. The seat unit is mounted at the track means of the base and movable relative to the base between a first position located adjacent to the first terminal end, and a second position located farther apart from the first terminal end. The wheel pedal unit is mounted at the track means of the base and movable relative to the base between a first pedaling position located adjacent to the second terminal end, such that the wheel pedal unit is located farther apart from the seat unit in the horizontal direction, and a second pedaling position located farther away from the second terminal end, such that the wheel pedal unit is located closer to the seat unit in the horizontal direction. Moving the seat unit between the first and second positions, as well as shifting the wheel pedal unit between the first and second pedaling positions, produces a change in the elevation difference, i.e. distance, between the wheel pedal unit and the seat unit in both the horizontal and vertical directions.

In view of the above, there are numerous benefits of moving the wheel pedal unit and the seat unit relative to the base to change the elevation difference between the seat unit and the wheel pedal unit. For example the relative position between the wheel pedal unit and the seat unit is relatively changed, thus allowing the user to selectively perform different exercise modes in a normal upright, or elevated, sitting posture or in a recumbent sitting posture.

Figure 1:
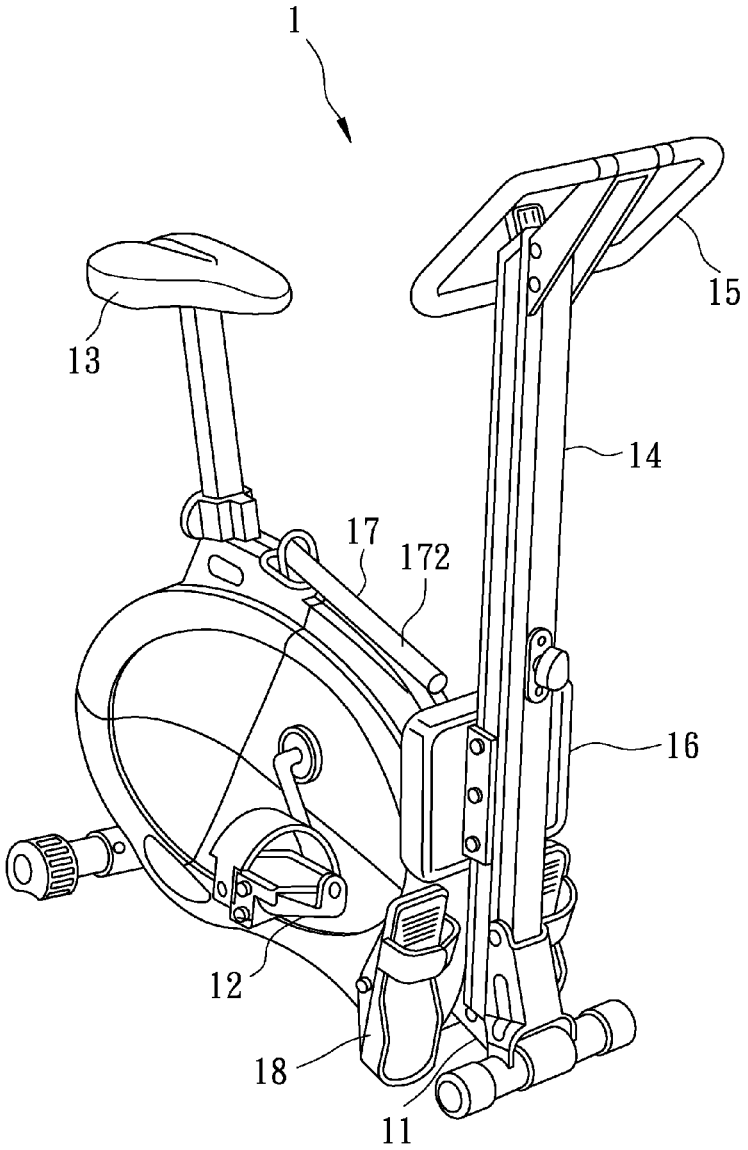
FIG. 1 PRIOR ART
FIG. 1 is a perspective view of a conventional multi-mode exercise machine.
Figure 2:
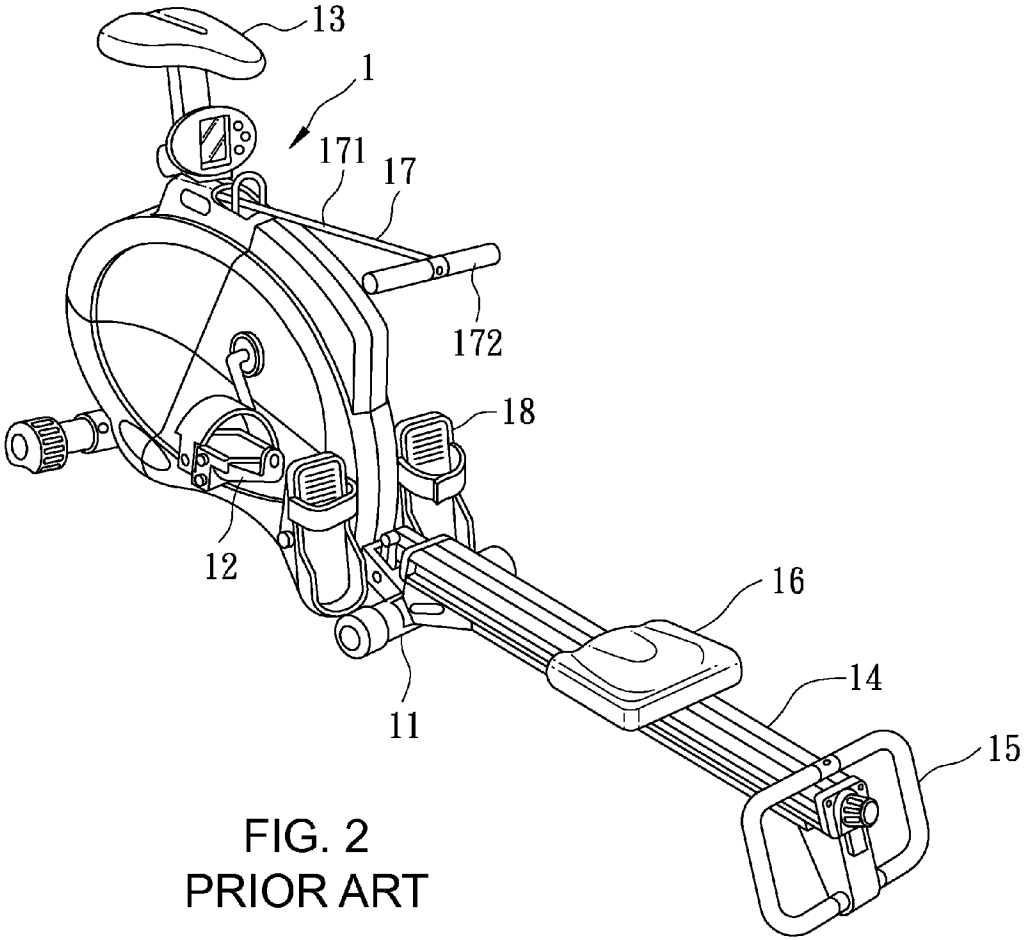
FIG. 2 PRIOR ART
FIG. 2 is another perspective view of the conventional exercise machine of FIG. 1, illustrating the arm changed from the vertical position to the horizontal position.

It should be noted that the drawing figures are not necessarily drawn to scale, but instead are drawn to provide a better understanding of the components thereof, and are not intended to be limiting in scope, but rather to provide exemplary illustrations. It should further be noted that the figures illustrate exemplary embodiments of an exercise apparatus and the components thereof, and in no way limit the structures or configurations of an exercise apparatus and components thereof according to the present disclosure.

DETAILED DESCRIPTION OF THE INVENTION

Other and further advantages and features of the present invention will be understood by reference to the following specification in conjunction with the accompanying drawings.

While the disclosure may be susceptible to various modifications and alternative constructions, certain illustrative embodiments are shown in the drawings and are described in detail below. It should be understood, however, that there is no intention to limit the disclosure to the specific embodiments disclosed, but on the contrary, the intention is to cover all modifications, alternative constructions, combinations, and equivalents falling within the spirit and scope of the disclosure.

It will be understood that, unless a term is expressly defined in this disclosure to possess a described meaning, there is no intent to limit the meaning of such term, either expressly or indirectly, beyond its plain or ordinary meaning.

Figure 3:
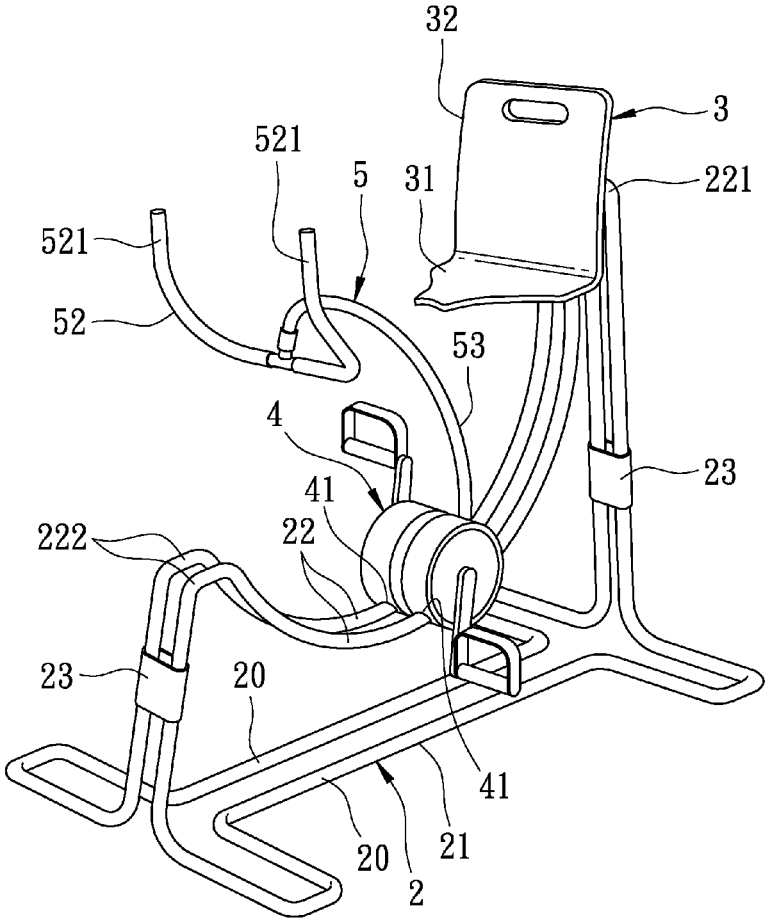
FIG. 3 is a front perspective view of an exercise apparatus in accordance with the present invention in a first position.
Figure 4:
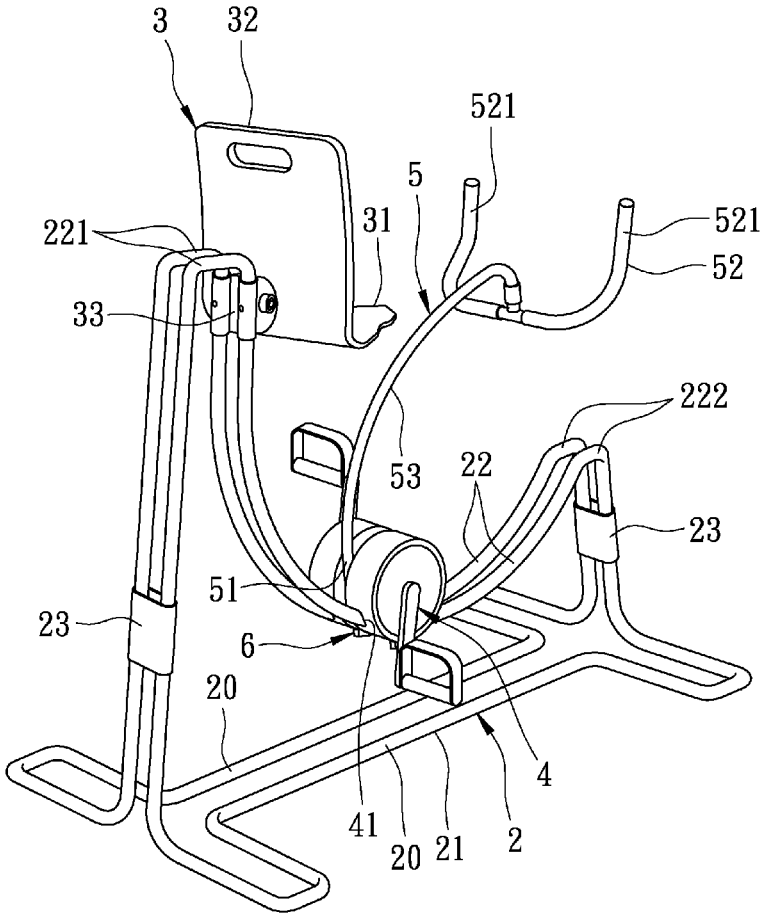
FIG. 4 is a rear perspective view of the exercise apparatus of FIG. 3, illustrating an increased elevation difference between the wheel pedal unit and the seat unit in the vertical direction and a reduced elevation difference in the horizontal direction.

Referring to FIGS. 3 and 4, an exercise apparatus in accordance with the present invention is shown comprising a base 2, a seat unit 3, a wheel pedal unit 4, a handle assembly 5, and two locking members 6.

The base 2 comprises two frame bar members 20, and two retaining members 23 fastened to the two frame bar members 20 to keep them in place. The two frame bar members 20 are arranged parallel to each other to provide a body 21 steadily positioned on a support surface, and a track 22 spaced above the body 21. The track 22 is inwardly curved and smoothly arched, and defines a first terminal end 221 and an opposite second terminal end 222. The first terminal end 221 and the opposite second terminal end 222 are spaced from each other at a predetermined distance.

Figure 5:
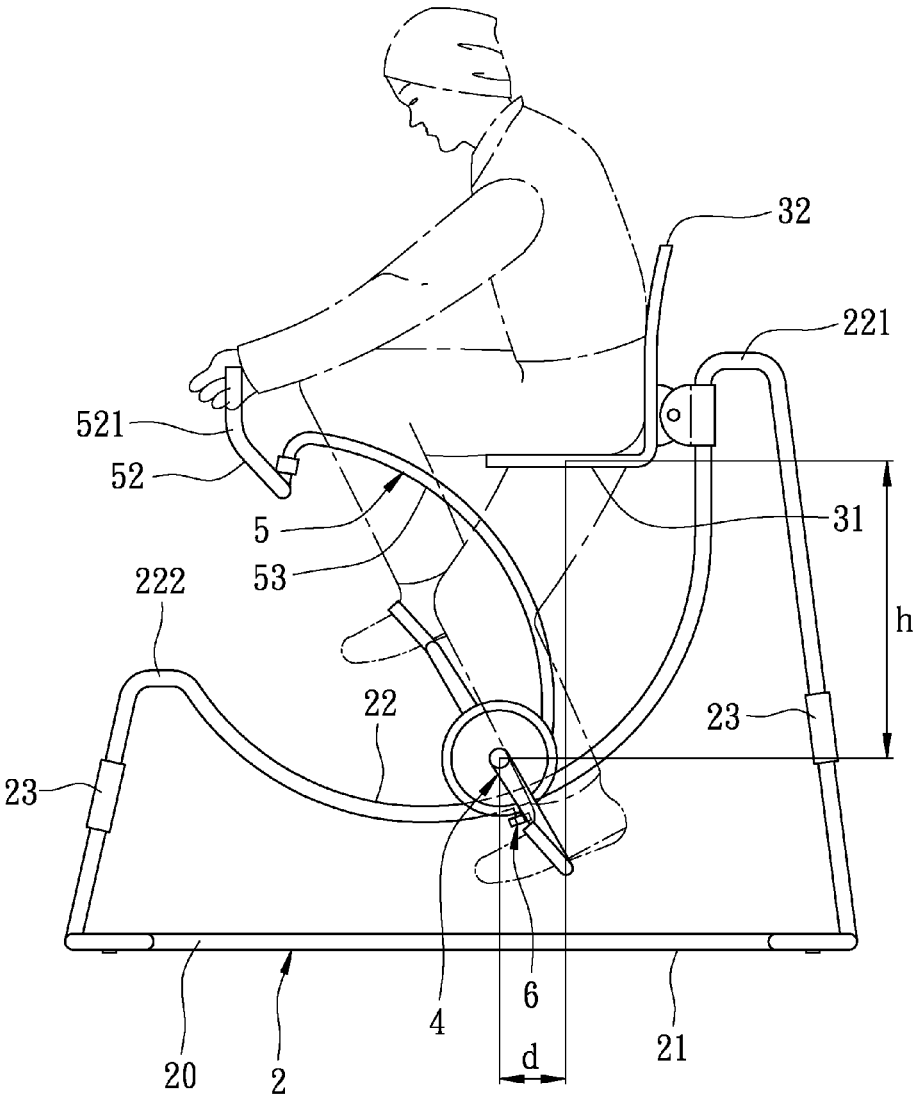
FIG. 5 is a schematic elevational view of the present invention, illustrating a user sitting on the seat unit in a normal sitting posture.

The seat unit 3 is movably mounted to the track 22 of the base 2, and comprises a seat cushion 31, a back cushion 32, and a coupling member 33 located at the back cushion 32 and slidably coupled to the frame bar members 20. By means of the coupling member 33, the seat unit 3 is movable relative to the base 2 between a first position located adjacent to the first terminal end 221 (see FIGS. 3 through 5), and a second position located farther apart from the first terminal end 221 (see FIGS. 6 and 7).

The wheel pedal unit 4 is movably mounted at the track 22 of the base 2, and comprises two through holes 41 configured to fit the curvature of the track 22 for the insertion of the frame bar members 20. Thus, the wheel pedal unit 4 can be slidably coupled to the frame bar members 20. By means of the through holes 41, the wheel pedal unit 4 can be moved along the frame bar members 20 between a first pedaling position where the wheel pedal unit 4 is located adjacent to the second terminal end 222 and far apart from the seat unit 3 (see FIGS. 6 and 7), and a second pedaling position where the wheel pedal unit 4 is located far apart from the second terminal end 222 and closer to the seat unit 3 (see FIGS. 3 through 5).

The handle assembly 5 comprises a coupling end piece 51 located at one end thereof and pivotally connected to the wheel pedal unit 4, and a handlebar 52 located at an opposite end thereof for the user's hands to hold onto. The handle assembly further includes an arched stem 53 connected between the coupling end piece 51 and the handlebar 52, and which is curved to correspond with the curvature of the track 22. The handlebar 52 has two opposite ends terminating in respective grips 521. Moreover, the size of the gap formed between the two grips 521 is larger than the width of the seat cushion 31.

The locking members 6 are respectively insertable into the through holes 41 in order to lock the wheel pedal unit 4 to the frame bar members 20. During operation of the exercise apparatus, the handle assembly 5 can be moved relative to the wheel pedal unit 4 between a first pedaling position where the arched stem 53 is closely attached to the track 22 and received between the two frame bar members 20 such that it lies substantially flush with the track 22 (see FIGS. 6 and 7), and a second pedaling position where the arched stem 53 is kept at a location far apart from the track 22 such that it extends outwardly therefrom (see FIGS. 3 through 5).

Referring again to FIGS. 3 through 5, the elevation difference h between the seat unit 3 and the wheel pedal unit 4 is maximized in the vertical direction and the elevation difference d between the seat unit 3 and the wheel pedal unit 4 is minimized in the horizontal direction. This occurs when the seat unit 3 is moved with the coupling member 33 along the track 22 to the first position adjacent to the first terminal end 221, and the wheel pedal unit 4 is moved by means of the through holes 41 along the frame bar members 20 toward the first terminal end 221 to the second pedaling position located farther away from the second terminal end 222 and horizontally adjacent to the seat unit 3. Thus, when the handle assembly 5 is adjusted to correspond to the second pedaling position, the user can sit on the seat unit 3 in a normal sitting posture and hold the grips 521 with their two hands positioned in front of the seat unit 3. At this time, subject to the curvature of the arched stem 51, the body's center of gravity is shifted forward, and the handle assembly 5 will not be pulled back. Thus, the user can pedal the wheel pedal units with their legs positioned below the seat unit 3.

Figure 6:
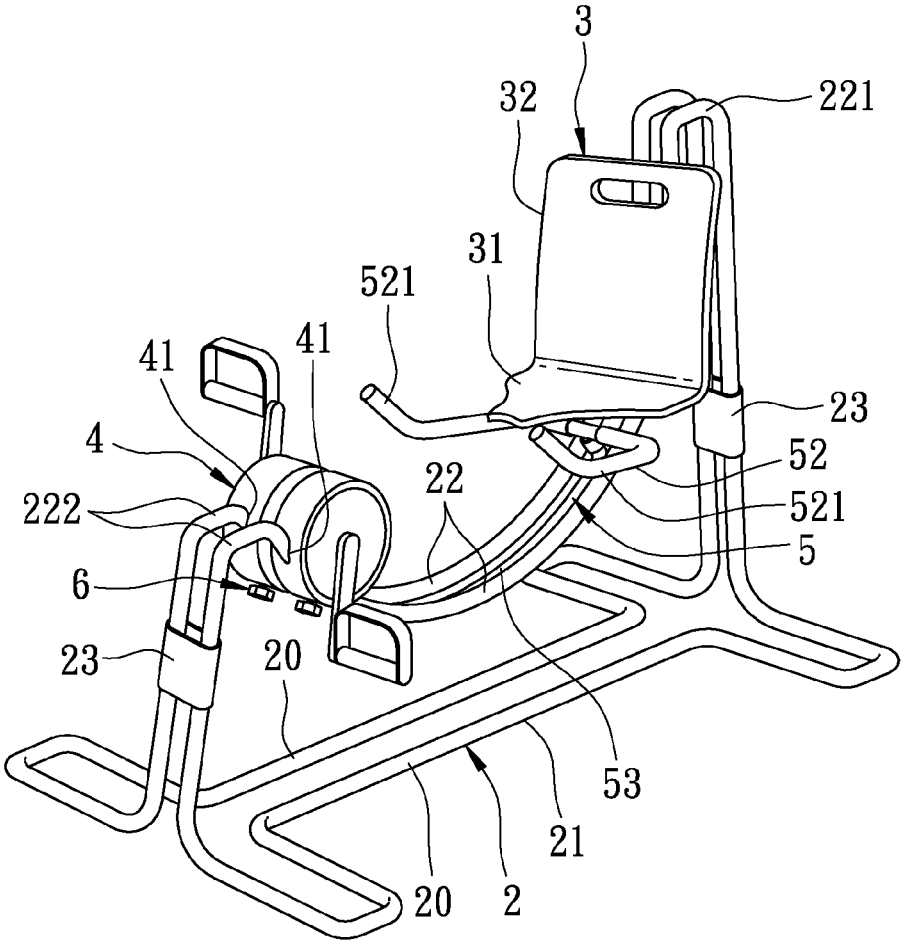
FIG. 6 is a perspective view of the exercise apparatus of FIG. 3 in a second position, illustrating the elevation difference between the wheel pedal unit and the seat unit is minimized in the vertical direction and maximized in the horizontal direction.
Figure 7:
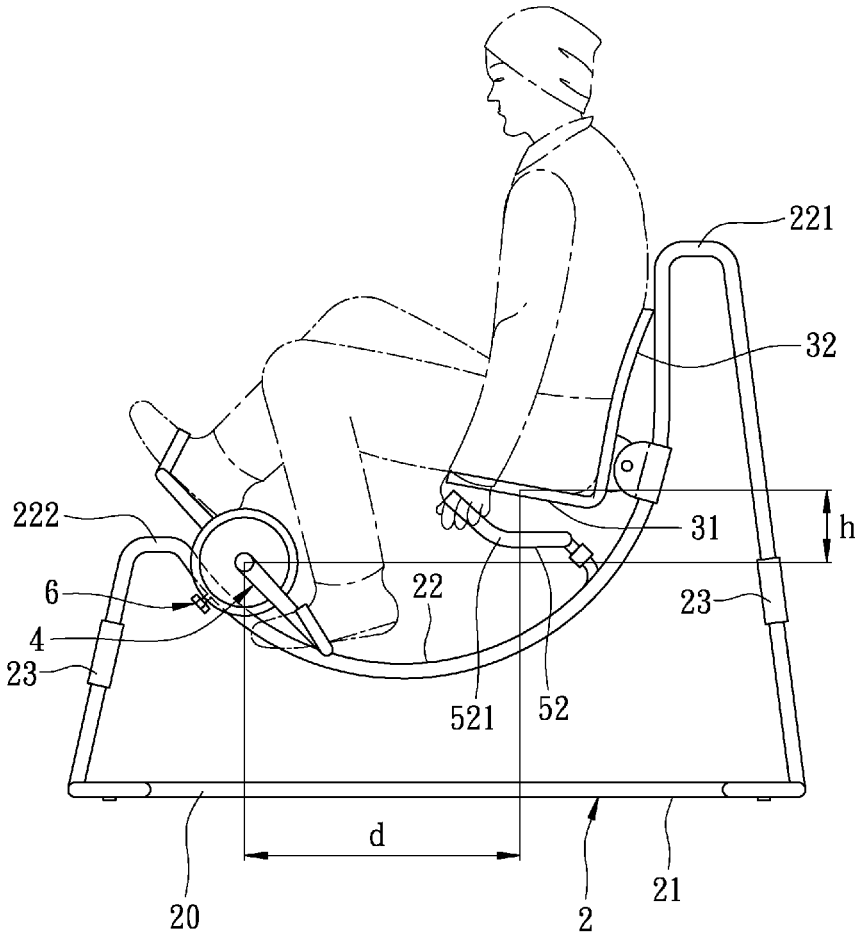
FIG. 7 is a schematic view of the exercise apparatus in the second position, illustrating the user sitting on the seat unit in a recumbent sitting posture.

Referring to FIGS. 6 and 7, the elevation difference h between the seat unit 3 and the wheel pedal unit 4 is minimized in the vertical direction and the elevation difference d between the seat unit 3 and the wheel pedal unit 4 is maximized in the horizontal direction. This occurs when the seat unit 3 is moved with the coupling member 33 along the track 22 to the second position located far apart from the first terminal end 221, and the wheel pedal unit 4 is moved by means of the through holes 41 along the frame bar members 20 toward the second terminal end 222 to the first pedaling position located farther horizontally from the seat unit 3. Thus, when the handle assembly 5 is adjusted to correspond to the first pedaling position, the user can sit on the seat unit 3 in a recumbent sitting posture. At this time, the user can hold the grips 521 with their two hands at two opposite lateral sides relative to the seat unit 3 and then pedal the wheel pedal unit 4 with their legs positioned in front of the seat unit 3 while sitting on the seat unit 3 in the recumbent sitting posture. This is because the gap between the two grips 521 is larger than the width of the seat cushion 31, and thus and the handlebar 52 does not protrude over the seat unit 3 in the vertical direction.

It is therefore apparent that the exercise apparatus of the present invention described herein has many benefits. By means of moving the seat unit 3 and the wheel pedal unit 4 to change the elevation difference d in the vertical direction, and the elevation difference h in the horizontal direction, the relative position between the seat unit 3 and the wheel pedal unit 4 is relatively changed. This allows the user to perform different exercise modes in either a normal sitting posture or a recumbent sitting posture. Thus, the simplified structure of the exercise apparatus of the present invention has enhanced practicality since it facilitates operation by advantageously incorporating only one single wheel pedal unit 4 and one seat unit 3 for performing different exercise modes.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An exercise apparatus, comprising:

a base comprising a first terminal end and a second terminal end located at different elevations and spaced from each other at a predetermined distance, and a track extending between said first and second terminal ends;

a seat unit mounted at said track of said base and movable relative to said base between a first position adjacent to said first terminal end and a second position spaced far apart from said first terminal end; and a wheel pedal unit mounted at said track of said base and movable relative to said base between a first pedaling position adjacent to said second terminal end and horizontally spaced far apart from said seat unit, and a second pedaling position spaced far apart from said second terminal end and located horizontally adjacent to said seat unit to produce a distance difference between said wheel pedal unit and said seat unit in a horizontal direction and a distance difference between said wheel pedal unit and said seat unit in each of said first and second positions in a vertical direction.

2. The exercise apparatus as claimed in claim 1, wherein said track is smoothly arched and inwardly curved, and said first and second terminal ends are respectively located at two opposite ends of said track.

3. The exercise apparatus as claimed in claim 2, wherein said base comprises at least one frame bar member having a body for positively positioning on a support surface, and forming said first and second terminal ends, wherein said track is located above said body and between said first and second terminal ends.

4. The exercise apparatus as claimed in claim 3, wherein said wheel pedal unit comprises at least one through hole configured to correspond with a curvature of said at least one frame bar member for the insertion of said at least one frame bar member therein.

5. The exercise apparatus as claimed in claim 4, further comprising at least one locking member.

6. The exercise apparatus as claimed in claim 5, wherein said at least one locking member is insertable into said at least one respective through hole to lock said wheel pedal unit to said track of said at least one frame bar member.

7. The exercise apparatus as claimed in claim 2, wherein said seat unit comprises a seat cushion, a back cushion, and a coupling member located at said back cushion and coupled to said track.

8. The exercise apparatus as claimed in claim 2, further comprising a handle assembly pivotally connected to said wheel pedal unit and movable relative to said wheel pedal unit between a first position in substantial alignment with said track and a second position extending away from said track.

9. The exercise apparatus as claimed in claim 8, wherein said handle assembly comprises a coupling end piece located at one end thereof and pivotally connected to said wheel pedal unit, a handlebar located at an opposite end thereof for holding by a user, and an arched stem connected between said coupling end piece and said handlebar.

10. The exercise apparatus as claimed in claim 9, wherein the arched stem is curved subject to the curvature of said track.

11. The exercise apparatus as claimed in claim 9, wherein said arched stem is configured such that said handlebar is kept spaced far apart from said seat unit when said handle assembly is in said second position.

12. The exercise apparatus as claimed in claim 9, wherein said arched stem is arranged to lie substantially flush with said track when said handle assembly is in said second position.

13. The exercise apparatus as claimed in claim 9, wherein said handlebar comprises two grips respectively located at two distal ends thereof, said grips being located at two opposite lateral sides relative to said seat unit when said handle assembly is in said first position.

14. The exercise apparatus as claimed in claim 1, wherein when said seat unit is in said first position and said wheel pedal unit is in said second pedaling position, the distance difference between said seat unit and said wheel pedal unit is maximized in the vertical direction and minimized in the horizontal direction, and when said seat unit is in said second position and said wheel pedal unit is in said first pedaling position, the distance difference between said seat unit and said wheel pedal unit is minimized in the vertical direction and maximized in the horizontal direction.

15. An exercise apparatus, comprising:

a base having at least two frame bar members arranged parallel to each other and defining a body for steadily positioning on a support surface;

an arched track spaced above the body, said track defining a first terminal end and an opposite second terminal end spaced from each other at a predetermined distance;

a seat unit movably mounted to the track of said base and movable relative to said base between a first position adjacent to said first terminal end and a second position spaced far apart from said first terminal end; and a wheel pedal unit movably mounted at the track of said base and movable relative to said base between a first pedaling position adjacent to said second terminal end and horizontally spaced far apart from said seat unit, and a second pedaling position spaced far apart from said second terminal end and located horizontally adjacent to said seat unit to produce a distance difference between said wheel pedal unit and said seat unit in a horizontal direction, and a distance difference between said wheel pedal unit and said seat unit in each of said first and second positions in a vertical direction.

16. The exercise apparatus as claimed in claim 15, wherein said first and second terminal ends are located at different elevations.

17. The exercise apparatus as claimed in claim 15, wherein the base further comprises two retaining members fastened to the at least two frame bar members for providing support.

18. An exercise apparatus, comprising:

a base having at least two curved frame bar members arranged parallel to each other and defining an arched track spaced above a body, said track defining a first terminal end and an opposite second terminal end spaced from each other at a predetermined distance;

a seat unit movably mounted to the track of said base and movable relative to said base between a first position adjacent to said first terminal end and a second position spaced far apart from said first terminal end;

a wheel pedal unit slidably mounted at the track of said base and movable relative to said base between a first pedaling position adjacent to said second terminal end and horizontally spaced far apart from said seat unit, and a second pedaling position spaced far apart from said second terminal end and located horizontally adjacent to said seat unit to produce a distance difference between said wheel pedal unit and said seat unit in a horizontal direction, and a distance difference between said wheel pedal unit and said seat unit in each of said first and second positions in a vertical direction; and wherein said wheel pedal unit comprises at least one through hole configured to correspondingly fit with the curvature of said at least one frame bar member for the insertion of said at least one frame bar member therein.

19. The exercise apparatus as claimed in claim 18, further comprising a handle assembly pivotally connected to said wheel pedal unit and pivotable relative to said wheel pedal unit between a first position in substantial alignment with said track and a second position extending away from said track.

20. The exercise apparatus as claimed in claim 19, wherein the handle assembly comprises a coupling end piece located at one end thereof and pivotally connected to said wheel pedal unit, a handlebar located at an opposite end thereof for holding by a user, and an arched stem connected between said coupling end piece and said handlebar, wherein said arched stem is arranged to lie substantially flush with said arched track when said handle assembly is in said second position.

* * * * *